US007761938B1

(12) United States Patent
Peters

(10) Patent No.: US 7,761,938 B1
(45) Date of Patent: Jul. 27, 2010

(54) INTEGRAL FLUSH-MOUNTED WATER SPOUT FOR TUBS AND ASSOCIATED METHOD

(76) Inventor: Jeffrey S. Peters, 4318 State Rt. 17B, Callicoon, NY (US) 12723

( * ) Notice: Subject to any disclaimer, the term of this patent is extended or adjusted under 35 U.S.C. 154(b) by 446 days.

(21) Appl. No.: 11/821,675

(22) Filed: Jun. 25, 2007

Related U.S. Application Data

(60) Provisional application No. 60/815,644, filed on Jun. 23, 2006.

(51) Int. Cl.
*E03C 1/04* (2006.01)

(52) U.S. Cl. ..... 4/678; 4/541.6

(58) Field of Classification Search ..... 4/678, 4/541.6

See application file for complete search history.

(56) References Cited

U.S. PATENT DOCUMENTS 4,340,039 A * 7/1982 Hibbard et al. ..... 4/541.6
4,559,653 A * 12/1985 Mathews ..... 4/541.6
4,717,078 A * 1/1988 Arp ..... 4/541.6
4,800,046 A 1/1989 Malek et al.
4,972,531 A 11/1990 Gravatt
5,495,627 A 3/1996 Leaverton et al.
5,810,262 A 9/1998 Ton
6,138,293 A * 10/2000 Mathews ..... 4/541.6
6,182,303 B1 * 2/2001 Gardenier et al. ..... 4/541.6
6,322,004 B1 11/2001 Perdreau et al.
6,675,404 B2 1/2004 Brennan
6,680,437 B2 1/2004 Sato
2007/0289057 A1 * 12/2007 Ludlow ..... 4/541.6

* cited by examiner

*Primary Examiner*—Khoa D Huynh
(74) *Attorney, Agent, or Firm*—Montgomery Patent and Design; Robert C. Montgomery; Joseph T Yaksich

(57) ABSTRACT

An apparatus and method for an integral flush-mounted waterspout, specifically for tubs is herein disclosed. The water spout is flush-mounted, contoured and angled appropriately to contain the discharge of water and subsequent drippage within the tub. No extended spigot or spout would be evident. The advantage of such a system, besides that of home fashion, is the elimination of injury to a person entering or exiting a tub. The flush-mounted waterspout could be alternatively embodied for sinks, showers and similar fixtures.

10 Claims, 3 Drawing Sheets

INTEGRAL FLUSH-MOUNTED WATER SPOUT FOR TUBS AND ASSOCIATED METHOD

RELATED APPLICATIONS

The present invention was first described in and claims the benefit of U.S. Provisional Application No. 60/815,644, filed Jun. 23, 2006, the entire disclosures of which are incorporated herein by reference.

FIELD OF THE INVENTION

The present invention relates generally to a new spout design for bath tub faucet systems and, more particularly, to a spout that is mounted flush to the side of the bath tub to eliminate the various accidents that are caused by the common extended spouts.

BACKGROUND OF THE INVENTION

Bathing in a bathtub is a common function. However, accidents often occur such as bumping into protruding water spouts with one's head and other body parts. This can be particularly troublesome for both young children and the elderly as they get into and out of the bathtub as well as move around while in the tub. Additionally, such spouts are often located wherever the installer chooses to put them, which doesn't always happen to be the optimal location. Likewise, conventional spouts are difficult to clean around and may clutter up the otherwise clean and simple look of a whirlpool, tub or shower. Accordingly, there exists a need for a means by which the above-mentioned disadvantages of conventional water spouts can be addressed.

Several attempts have been made in the past to design a spout that is mounted flush to the side of the bath tub to eliminate the various accidents that are caused by the common extended spouts. U.S. Pat. No. 6,680,437 in the name of Sato discloses a grommet with a small diameter drum portion, a large diameter drum portion, and a lip portion. A fitting groove is fitted into a through hole of a panel that is provided on an outer wall surface. The lip portion protrudes to an outer side of the outer wall surface of the large diameter drum portion so as to contact closely with the panel. In the grommet, a rear surface side of the large diameter drum portion is thin. Due to a thin-wall portion which is formed by thinning the rear surface side of the large diameter drum portion, upon opening a molding die, the lip portion with a large undercut amount elastically deforms to a side of the thin-wall portion. As a result, the grommet can be easily released. Unfortunately, this prior art example protrudes from a bathtub wall and may therefore cause various accidents.

U.S. Pat. No. 6,675,404 in the name of Brennan discloses a system for control of water delivery to an interior of a tub, spa or shower that includes a plurality of ports and a flow control device. The plurality of ports is adapted to be located on a surface of the tub, spa, or shower and the plurality of ports is configured to transmit water to an interior of the tub, spa, or shower. A first pipe of the flow control device includes a plurality of elongated inlets and a second pipe includes a plurality of outlets in fluid communication with the plurality of ports. The first pipe or the second pipe is moveable, one relative to the other. Moving of the first pipe or the second pipe to a first position serves to cause communication of an elongated inlet of the plurality of elongated inlets with a first outlet of the plurality of outlets.

The first outlet is in fluid communication with a first port of the plurality of ports. The communication of the inlet with the first outlet serves to allow flow of water from a water source, when in fluid communication with the flow control device, to the inlet to the first outlet to the first port to the interior of the tub, spa or shower. The moving of the first pipe or the second pipe also serves to block a second outlet of the plurality of outlets with a solid portion of the first pipe. The second outlet is in fluid communication with a second port of the plurality of ports. The blocking of the second outlet with the solid portion serves to prevent flow of water from the water source to the second port to the interior of the tub, spa or shower.

Moving of the first pipe or the second pipe to a second position of the plurality of positions serves to allow the first elongated inlet to remain in fluid communication with the first outlet and the first outlet to remain in fluid communication with the first port. Unfortunately, this prior art example protrudes from a bathtub wall and may therefore cause various accidents.

U.S. Pat. No. 5,810,262 in the name of Ton describes a discharge jet assembly for spas including a rear wall fitting, an orifice cap closing the rear wall fitting, and a jet body rotatably mounted within the wall fitting. The rear wall fitting includes a cylindrical central cavity and a vertically disposed air orifice opening into the central cavity. A rear portion of the jet body defines a cylindrical mixing chamber fed by a horizontal cylindrical water inlet and by an air inlet channel formed in the outer circumference of the jet body. The air inlet channel is positioned so as to rotate into and out of communication with the air orifice of the rear wall fitting. The jet body further includes a structure for interacting with a stop on the orifice cap so as to appropriately limit rotation of the jet body air inlet channel with respect to the air orifice. An arced continuous seal containment groove and integrally mounted seal surrounds the air inlet channel so as to provide an airtight seal between the rear wall fitting and the jet body. Male retainer elements employing rearward-facing split projections which plug into complementary openings in a female retainer element facilitate mounting of various nozzle styles within the jet assembly.

Axial flutes formed in a barrel portion of an eyeball nozzle component provide a flow rate enhancing feature. Unfortunately, this prior art example protrudes from a bathtub wall and may therefore cause various accidents.

None of the prior art particularly describes a spout that is mounted flush to the side of the bath tub to eliminate the various accidents that are caused by the common extended spouts. Accordingly, there is a need for an integral flush-mounted water spout for tubs. The present invention is simple to use, inexpensive, and designed for many years of repeated use.

SUMMARY OF THE INVENTION

In view of the foregoing disadvantages inherent in the prior art, it has been observed that there is need for an integral flush-mounted water spout for tubs that is mounted flush to the side of the bath tub to eliminate the various accidents that are caused by the common extended spouts.

The invention as presently conceived discloses a unique system and method for an integral flush-mounted waterspout specifically for tubs. Although resembling a standard jet port prevalent on conventional whirlpool-type tubs, the novel water outlet is flush-mounted, contoured and angled appropriately to contain the discharge of water and subsequent drippage within the tub. No extended spigot or spout would be evident. The inventor also envisions that such a waterspout could be configured for retrofitting existing tubs. The advantage of such a system, besides that of home fashion, is the elimination of injury to a person entering or exiting a tub. The flush-mounted waterspout could be alternatively embodied for sinks, showers and similar fixtures. The nearly flush-mounted feature virtually eliminates the possibility of one hitting their head, shoulders, back, knees or the like on such appendages and provides for a safer and more pleasant bathing experience.

The water dispensing apparatus for use with an existing reservoir includes a rigid body effectively including an upper planar surface adaptable between a horizontal plane and a downwardly sloping plane offset from the horizontal plane. Such a body further includes a front planar surface registered orthogonal to the upper planar surface. The body is pivotally adaptable along a fulcrum axis defined orthogonal to the longitudinal axis and is articulated between downwardly facing and horizontally facing positions defined within the diameter of the water outlet.

The apparatus further includes a water outlet situated about the body and positioned interior of the existing reservoir. The body is pivotally interfitted within such a water outlet, and a conduit is in fluid communication with the water outlet and an existing water supply source for directing water into the existing reservoir. Such a conduit conveniently has an inlet cooperating with the body and the water outlet such that the water is channeled into the existing reservoir along a travel path penetrating through the body. Such an inlet has an inner diameter smaller than an outer diameter of the water outlet such that the inlet is interfitted therein and maintained in fluid communication with the body. The inlet is centrally aligned with a centrally registered longitudinal axis of the water outlet and remains statically affixed at a predetermined position while the body is articulated between horizontal and downwardly angled positions. The inlet is also adjustably mated with the body such that the water outlet is anchored at a fixed position while the body is pivoted downwardly from within the diameter of the water outlet.

The conduit further includes an outlet with a diameter substantially equal to the diameter of the inlet. Such an outlet is advantageously angled downwardly from the longitudinal axis. The upper and front planar surfaces become forwardly disposed away from a front face of the water outlet when the body is pivoted to the downwardly sloping plane.

A method of utilizing a water dispensing apparatus includes the steps of removing an existing water spigot from an existing reservoir; affixing the water dispensing apparatus to the existing reservoir such that an inlet of a conduit of the water dispensing apparatus is in fluid communication with a water outlet of the water dispensing apparatus; angling a body of the water dispensing apparatus downwardly towards a bottom surface of the existing reservoir; turning on the existing water supply source by adapting at least one existing water control lever to an on position; and continuously directing water into the existing reservoir by pivoting the body between raised and lowered positions while the water outlet and the conduit remain statically affixed at an anchored position.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | integral flush-mounted water spout |
| 15 | contoured surface |
| 16 | swivel outlet |
| 17 | swivel motion |
| 20 | bath tub |
| 30 | water |
| 40 | water source |
| 45 | water source outlet |
| 50 | conduit |
| 53 | conduit inlet portion |
| 55 | conduit outlet portion |
| 60 | body |
| 61 | upper planar surface |
| 62 | horizontal plane |
| 63 | sloping plane |
| 64 | front planar surface |
| 65 | fulcrum axis |
| 66 | longitudinal axis |
| 67 | downwardly facing position |
| 68 | horizontally facing position |
| 69 | water outlet |
| 70 | reservoir |
| 71 | inner diameter |
| 72 | outer diameter |

DETAILED DESCRIPTION OF THE PREFERRED EMBODIMENT

Figure 1:
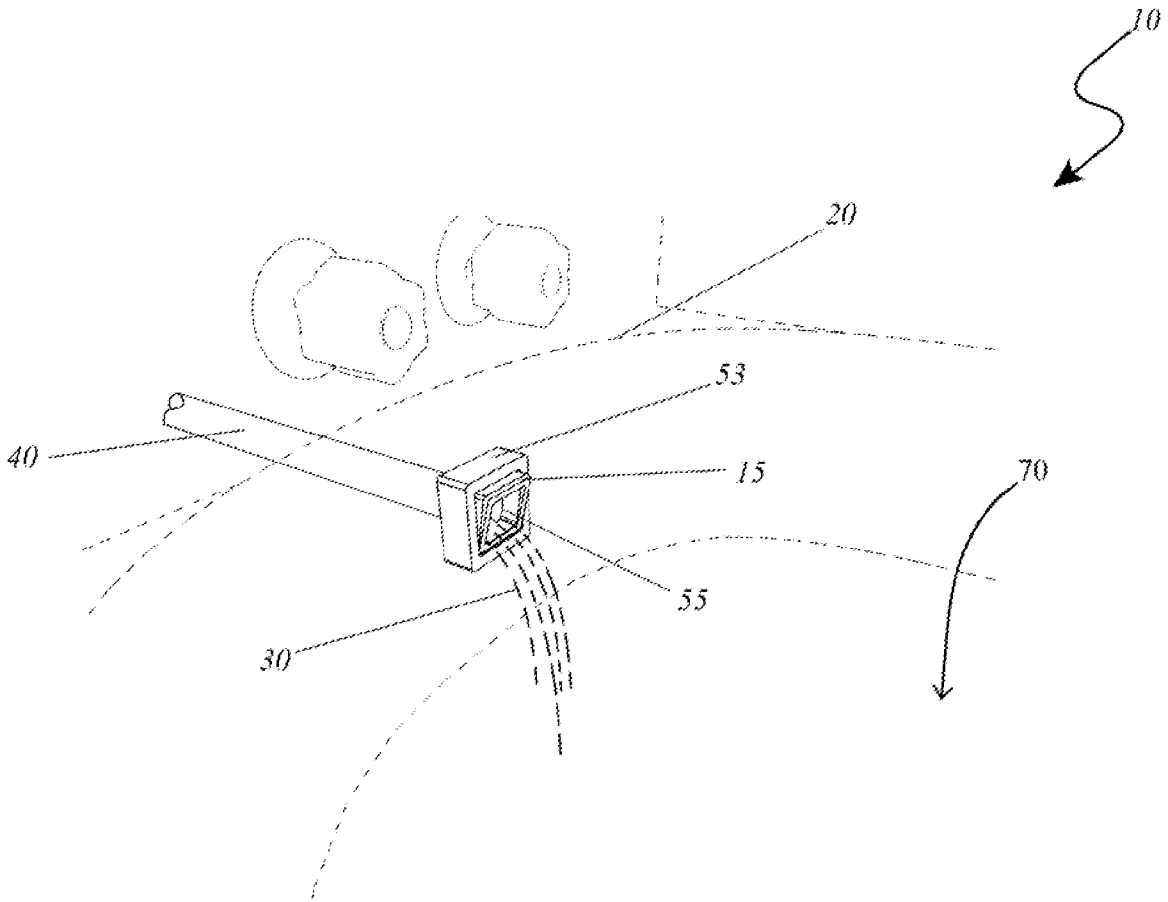
FIG. 1 is an environmental view of an integral flush-mounted water spout for tubs 10, according to the preferred embodiment of the present invention.
Figure 2:
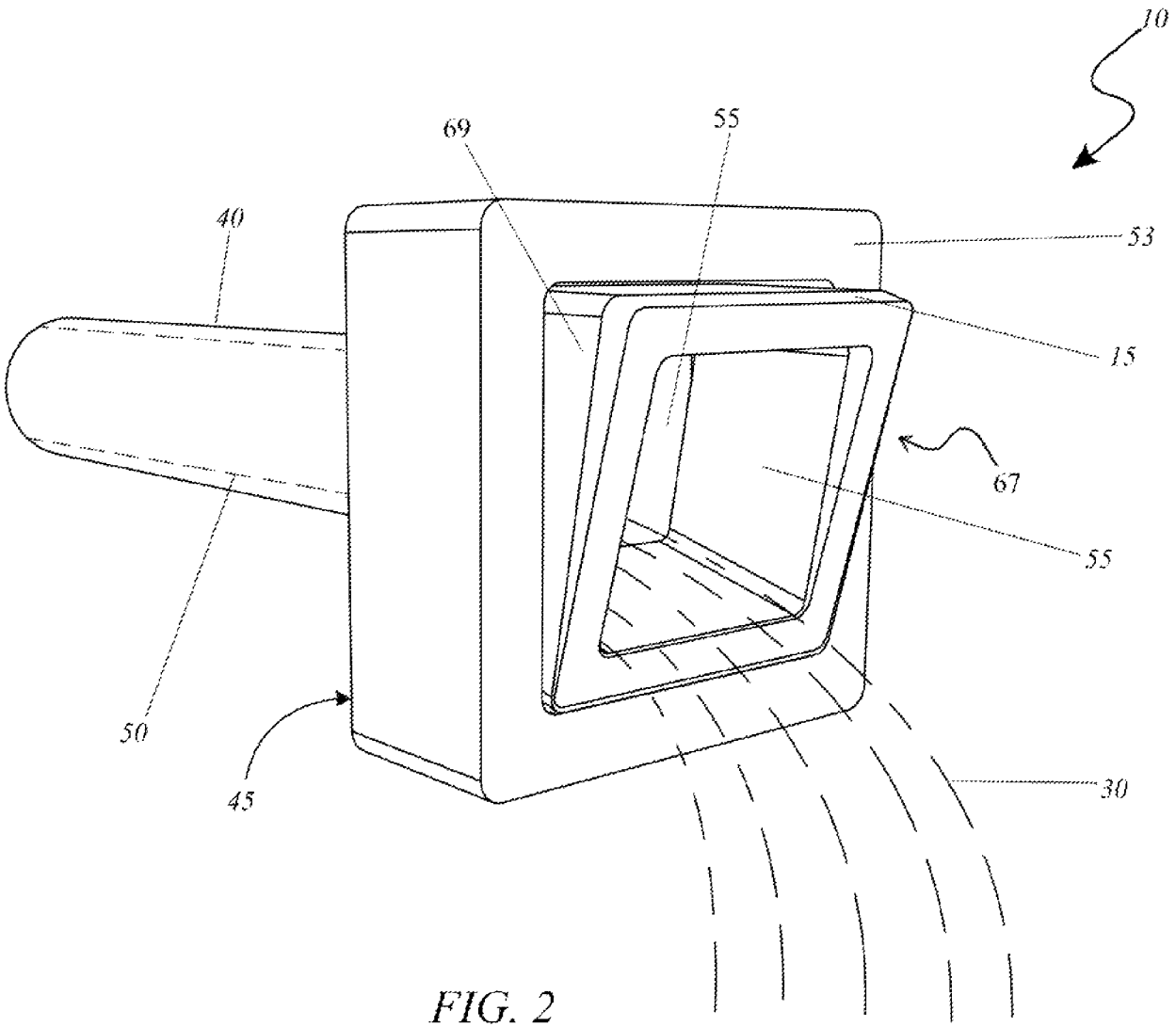
FIG. 2 is a side view of the integral flush-mounted water spout for tubs 10, according to the preferred embodiment of the present invention; and, FIG. 3 is a side view of the integral flush-mounted water spout for tubs 10, according to an alternate embodiment of the present invention.
Figure 3:
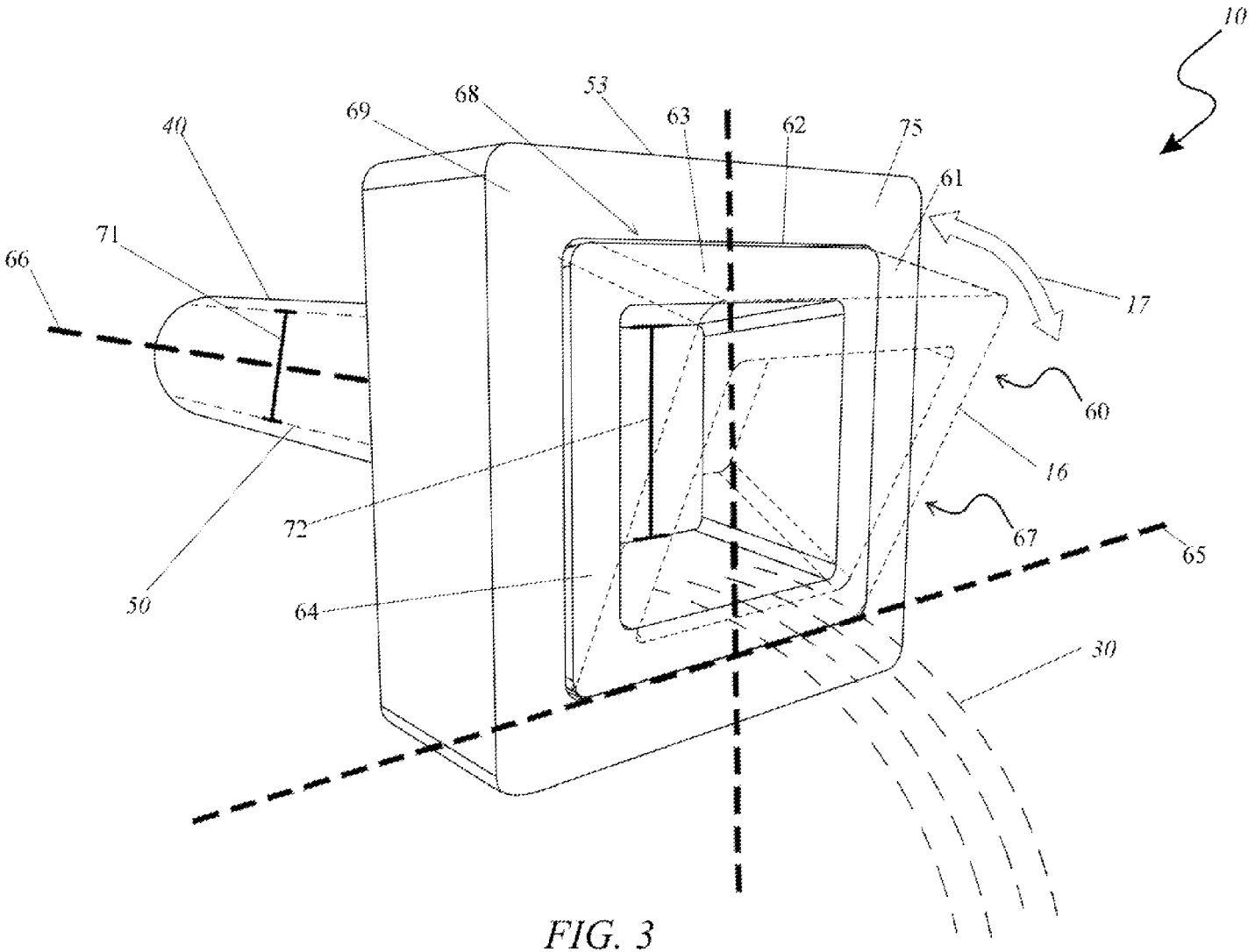

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for an integral flush-mounted water spout (herein described as the "apparatus") 10 comprises a housing specifically designed with contoured planes 15 and edges, a conduit 50, and means for connection of the apparatus 10 thereto already-existing piping systems. The apparatus 10 comprises a flush-mounted feature for water 30 delivery control to an interior of a tub 20, shower, or spa. The apparatus 10 is envisioned to be fabricated from one (1) or more custom molds to allow for proper installation with a method for connection of conventional piping.

Referring now to FIG. 1, an environmental view of the apparatus 10 according to the preferred embodiment of the present invention, is disclosed. The apparatus 10 is envisioned to utilize conventional connection means similar to dispersing appendages such as flush-mounted water spouts, spigots, shower heads and the like to replace said appendages. As depicted in FIG. 1, the apparatus 10 is flush-mounted, contoured and angled to contain the discharge of water 30 and subsequent drippage within the tub 20, spa, or shower. The apparatus 10 is envisioned to comprise surfaces which may include curves, contours 15 and/or planes protruding minimally outward therefrom the surface of the tub 20, spa, or shower. The apparatus 10 comprises an upper contoured surface 15 arced downwardly therefrom the plane of the tub 20, spa, or shower surface and a diagonally slanted plane connecting one end of the contoured surface 15 to the said plane with filleted ends thereby eliminating all corners or sharp edges thereof. The apparatus 10 is secured thereon the tub 20, spa, or shower surface by such fastening securement means such as, but not limited to, bolts and nuts, screws, gaskets, sealant, and/or adhesives.

Referring now to FIG. 2, a side view of the apparatus 10 according to the preferred embodiment of the present invention, is disclosed. The various appendages that actually disperse water 30 are an integral part of the enclosure and are made as part of the apparatus 10 during the manufacturing process. The apparatus 10 utilizes conventional piping of water spouts, spigots, shower heads, and the like as a source for water 30 flow being transformed and adapted upon a surface of a tub 20, spa, or shower. The piping of the water spouts, spigots, showerheads, and the like (herein described as the "water source") 40 is in fluid communication with the apparatus 10 such as to direct the water flow 30. The apparatus 10 is intended to discharge water 30 from a water source 40 utilizing existing flow control devices of said water sources 40. The tub 20, spa, or shower is envisioned to comprise an interior to receive, hold, circulate, and/or drain the discharged water 30 emanating therefrom the apparatus 10.

The apparatus 10 defines a conduit 50 that resides in interaction with a water outlet 45 of the water source 40 operably to be placed in fluid communication with the apparatus 10. The inlet 53 of the conduit 50 and the outlet 45 of the water source 40 is sized for the cooperative fluid communication of the water 30 and passage therethrough. For example, the conduit 50 comprises an inlet 53 having an inner diameter larger or smaller than that of the water outlet 45 of the water source 40 to correspondingly be inserted therein or otherwise engage thereto and affixed by means of welding, soldering, or other means of fastening. The inlet 53 of the conduit 50 may comprise an opening having an inner wall defining a threaded or grooved region (not pictured) positioned at the inlet 53 opening for receiving and cooperating with the threaded or grooved region of the water outlet 45 of the water source 40, thereby providing a fluid communication between the said inlet 53 of the conduit 50 and the outlet 45 of the water source 40. The inlet portion 53 may extend through an aperture in a tub 20, spa, shower, wall, or other partitions to connect with the outlet 45 of the water source 40.

The inlet 53 of the conduit 50 residing within the apparatus 10 is envisioned to be aligned therewith the axis of the outlet 45 and the water source 40. As the conduit 50 continues from the inlet 53, it contours downwardly at a desirable angle to direct the water flow 30 downwardly in the same fashion. The conduit 50 also comprises an outlet 55 preferably having a diameter or area similar to the inlet portion 53 of said conduit 50. The outlet portion 55 is angled downwardly therefrom the horizontal axis of the inlet portion 53 to discharge the water 30 downwardly such that the flow of said water 30 will approach the bottom surface of the tub 20, spa, or shower in a rapid and convenient motion.

Referring now to FIG. 3, a side view of the apparatus 10 according to an alternate embodiment of the present invention, is disclosed. The apparatus 10 as illustrated here provides an adjustably secured swivel outlet 16 means to manipulate the strength and/or angular position to which water flow 30 may occur. Such control may be achieved by having a swivel outlet 16 mounted into a ball socket type conduit inlet portion 53 therein providing a swivel motion 17, thereby directing the water flow 30 accordingly. The water dispensing apparatus 10 for use with an existing reservoir 70 includes a rigid body 60 effectively including an upper planar surface 61 adaptable between a horizontal plane 62 and a downwardly sloping plane 63 offset from the horizontal plane 62. Such a body 60 further includes a front planar surface 64 registered orthogonal to the upper planar surface 61. The body 60 is pivotally adaptable along a fulcrum axis 65 defined orthogonal to the longitudinal axis 66 and is articulated between downwardly facing 67 and horizontally facing 68 positions defined within the diameter of the water outlet 69. The apparatus 10 further includes a water outlet 69 situated about the body 60 and positioned interior of the existing reservoir 70. The body 60 is pivotally interfitted within such a water outlet 69, and a conduit 50 is in fluid communication with the water outlet 69 and an existing water supply source for directing water into the existing reservoir 70. Such a conduit 50 conveniently has an inlet 53 cooperating with the body 60 and the water outlet 69 such that the water is channeled into the existing reservoir 70 along a travel path penetrating through the body 60. Such an inlet 53 has an inner diameter 71 smaller than an outer diameter 72 of the water outlet 69 such that the inlet 53 is interfitted therein and maintained in fluid communication with the body 69. The inlet 53 is centrally aligned with a centrally registered longitudinal axis 66 of the water outlet 69 and remains statically affixed at a predetermined position while the body 60 is articulated between horizontal 68 and downwardly 67 angled positions. The inlet 53 is also adjustably mated with the body 60 such that the water outlet 69 is anchored at a fixed position while the body 60 is pivoted downwardly from within the diameter 72 of the water outlet 69. The upper 61 and front 64 planar surfaces become forwardly disposed away from a front face 75 of the water outlet 69 when the body 60 is pivoted to the downwardly sloping plane 63.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the integral flush-mounted water spout for tubs 10, it would be configured as indicated in FIGS. 1 and 2.

The method of utilizing the device may be achieved by performing the following steps: removing the already fastened spigot, shower head, water spout, or the like out of the bath tub 20, shower, spa, wall or other partitions, if needed; placing the apparatus 10 at the same location as the removed spigot, shower head, water spout, or the like such that the inlet 53 of the conduit 50 is in fluid communication with the outlet 45 of the water source 40 and positioning the apparatus 10 such that the outlet 55 of the conduit 50 is angled downwardly; securing the apparatus 10 thereon the bath tub 20, shower, spa, wall or other partitions utilizing conventional fastening methods such as, but not limited to: bolts and nuts, screws, gaskets, sealant, and/or adhesives; turning on the water source 40 utilizing already-existing water control devices; directing the water flow 30 continuously into the conduit 50 and disbursed therefrom the outlet 55 of the conduit 50 until otherwise shut off; alternately utilizing a swivel outlet 16 embodiment, thereby adjustably directing the downward angle of the water flow 30; turning off the water source 40 utilizing already-existing water control devices, when desired; and, enjoying increased safety experienced by children, elderly, and disabled people by reducing the possibility of hitting one's head, shoulders, back, knees or the like on such appendages as found on traditional extended spigots or spouts and providing an aesthetically pleasing water spout invention 10.

The apparatus 10 is envisioned to be positioned on an inner wall of a tub 20. However, it may be installed in a variety of configurations and locations such as, but not limited to: mounting the apparatus 10 thereupon an adjacent wall with the possibility of utilizing extensions such to extend the apparatus 10 therefrom said wall; or mounting the apparatus 10 thereupon sinks or other fixtures; and as such should not be interpreted as a limiting factor of the present invention 10. Furthermore, although the apparatus 10 is envisioned to be installed in the same location as the spigot, shower head, water spouts, or the like, the tub 20 and/or wall may be modified for other applicable positions of the apparatus 10 thereupon.

An alternate embodiment of the current invention 10 would be to incorporate the apparatus 10 as an option on new tub enclosures 20 as well as new enclosure designs.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A water dispensing apparatus for use with an existing reservoir, said water dispensing apparatus comprising:

a rigid body including an upper planar surface pivotal between a horizontal plane and a downwardly sloping plane offset from said horizontal plane, said body further including a front planar surface registered orthogonal to said upper planar surface;

a water outlet situated about said body and positioned interior of said existing reservoir, said body being pivotally interfitted within said water outlet; and, a conduit in fluid communication with said water outlet and an existing water supply source for directing water into the existing reservoir, said conduit having an inlet cooperating with said body and said water outlet such that the water is channeled into the existing reservoir along a travel path penetrating through said body.

2. The water dispensing apparatus of claim 1, wherein said inlet has an inner diameter smaller than an outer diameter of said water outlet such that said inlet is interfitted therein and maintained in fluid communication with said body.

3. The water dispensing apparatus of claim 2, wherein said inlet is centrally aligned with a centrally registered longitudinal axis of said water outlet and remain statically affixed at a predetermined position while said body is articulated between horizontal and downwardly angled positions.

4. The water dispensing apparatus of claim 3, wherein said inlet is adjustably mated with said body such that said water outlet is anchored at a fixed position while said body is pivoted downwardly from within said diameter of said water outlet.

5. The water dispensing apparatus of claim 1, wherein said body is pivotally adaptable along a fulcrum axis defined orthogonal to said longitudinal axis, said body being articulated between downwardly facing and horizontally facing positions defined within said diameter of said water outlet.

6. A water dispensing apparatus for use with an existing reservoir, said water dispensing apparatus comprising:

a rigid body including an upper planar surface pivotal between a horizontal plane and a downwardly sloping plane offset from said horizontal plane, said body further including a front planar surface registered orthogonal to said upper planar surface;

a water outlet situated about said body and positioned interior of said existing reservoir, said body being pivotally interfitted within said water outlet; and, a conduit in fluid communication with said water outlet and an existing water supply source for directing water into the existing reservoir, said conduit having an inlet cooperating with said body and said water outlet such that the water is channeled into the existing reservoir along a travel path penetrating through said body;

wherein said upper and front planar surfaces become forwardly disposed away from a front face of said water outlet when said body is pivoted to the downwardly sloping plane.

7. The water dispensing apparatus of claim 6, wherein said inlet has an inner diameter smaller than an outer diameter of said water outlet such that said inlet is interfitted therein and maintained in fluid communication with said body.

8. The water dispensing apparatus of claim 7, wherein said inlet is centrally aligned with a centrally registered longitudinal axis of said water outlet and remain statically affixed at a predetermined position while said body is articulated between horizontal and downwardly angled positions.

9. The water dispensing apparatus of claim 8, wherein said inlet is adjustably mated with said body such that said water outlet is anchored at a fixed position while said body is pivoted downwardly from within said diameter of said water outlet.

10. The water dispensing apparatus of claim 7, wherein said body is pivotally adaptable along a fulcrum axis defined orthogonal to said longitudinal axis, said body being articulated between downwardly facing and horizontally facing positions defined within said diameter of said water outlet.

* * * * *